US008777562B2

(12) United States Patent
Strock et al.

(10) Patent No.: US 8,777,562 B2
(45) Date of Patent: Jul. 15, 2014

(54) BLADE AIR SEAL WITH INTEGRAL BARRIER

(75) Inventors: Christopher W. Strock, Kennebunk, ME (US); Melvin Freling, West Hartford, CT (US)

(73) Assignee: United Techologies Corporation, Hartford, CT (US)

( * ) Notice: Subject to any disclaimer, the term of this patent is extended or adjusted under 35 U.S.C. 154(b) by 486 days.

(21) Appl. No.: 13/246,390

(22) Filed: Sep. 27, 2011

(65) Prior Publication Data

US 2013/0078085 A1 Mar. 28, 2013

(51) Int. Cl.
*F01D 11/08* (2006.01)

(52) U.S. Cl.
USPC ..... 415/173.1; 415/173.4; 415/174.4

(58) Field of Classification Search
USPC ..... 415/170.1, 173.1, 173.4, 174.4, 200; 416/241 R; 428/701, 304.4
See application file for complete search history.

(56) References Cited

U.S. PATENT DOCUMENTS

| | | | | |
|---|---|---|---|---|
| 5,262,206 | A | 11/1993 | Rangaswamy et al. | |
| 5,434,210 | A | 7/1995 | Rangaswamy et al. | |
| 5,536,022 | A | 7/1996 | Sileo et al. | |
| 5,780,116 | A | 7/1998 | Sileo et al. | |
| 5,976,695 | A | 11/1999 | Hajmrle et al. | |
| 6,808,756 | B2 | 10/2004 | Hajmrle et al. | |
| 6,887,530 | B2 | 5/2005 | Fiala et al. | |
| 7,008,462 | B2 | 3/2006 | Fiala et al. | |
| 7,052,527 | B2 | 5/2006 | Hajmrle et al. | |
| 7,135,240 | B2 | 11/2006 | Fiala et al. | |
| 7,179,507 | B2 | 2/2007 | Fiala et al. | |
| 7,582,362 | B2 | 9/2009 | Fiala et al. | |
| 7,763,573 | B2 | 7/2010 | Hajmrle et al. | |
| 2004/0142196 | A1* | 7/2004 | Hajmrle et al. | 428/545 |
| 2005/0124505 | A1 | 6/2005 | Hajmrle et al. | |
| 2010/0080984 | A1* | 4/2010 | Lee | 428/334 |
| 2010/0129636 | A1* | 5/2010 | Cybulsky et al. | 428/310.5 |
| 2010/0136349 | A1* | 6/2010 | Lee | 428/446 |
| 2010/0266391 | A1 | 10/2010 | Schlichting et al. | |
| 2011/0033630 | A1* | 2/2011 | Naik et al. | 427/452 |
| 2012/0128879 | A1* | 5/2012 | Cybulsky et al. | 427/243 |

FOREIGN PATENT DOCUMENTS

| | | |
|---|---|---|
| EP | 2 063 072 A2 | 5/2009 |
| EP | 2 192 098 A2 | 6/2010 |

OTHER PUBLICATIONS

European Search Report for EP Application No. 12186292.4, Mar. 5, 2013.

* cited by examiner

*Primary Examiner* — Igor Kershteyn
(74) *Attorney, Agent, or Firm* — Carlson, Gaskey & Olds, P.C.

(57) ABSTRACT

An air seal for use with rotating parts includes a thermal barrier coating layer adhered to a substrate. An abradable layer is adhered to the thermal barrier coating layer. The abradable layer comprises a matrix of agglomerated hexagonal boron nitride and a metallic alloy. Another hexagonal boron nitride is interspersed with the matrix.

14 Claims, 1 Drawing Sheet

BLADE AIR SEAL WITH INTEGRAL BARRIER

BACKGROUND OF THE INVENTION

This disclosure relates to an air seal for a gas turbine engine.

In compressor and turbine sections of a gas turbine engine, air seals are used to seal the interface between rotating structure, such as a hub or a blade, and fixed structure, such as a housing or a stator. For example, typically, circumferentially arranged blade seal segments are fastened to a housing, for example, to provide the seal.

Relatively rotating components of a gas turbine engine are not perfectly cylindrical or coaxial with one another during engine operation. As a result, the relatively rotating components may occasionally rub against one another. To this end, an abradable material typically is adhered to the blade seal segments and/or the rotating component.

SUMMARY

An embodiment addresses an air seal for use with rotating structure in a gas turbine engine may include: a substrate; a thermal barrier coating layer adhered to the substrate; and an abradable layer adhered to the thermal barrier coating layer. The abradable layer may include a matrix of agglomerated hexagonal boron nitride and a metallic alloy, and an hexagonal boron nitride. The hexagonal boron nitride may be interspersed with the matrix.

In a further embodiment of the foregoing air seal embodiment, the substrate may be metallic.

In a further embodiment or either of the foregoing air seal embodiments, the thermal barrier coating may be 7% yttria stabilized zirconia.

In another further embodiment of any of the foregoing air seal embodiments, the abradable layer may have a strength of at least 1000 psi (6.89 MPa).

In another further embodiment of any of the foregoing air seal embodiments, the agglomerated hexagonal boron nitride may include particles of between 1-10 microns, the fine metallic alloy may include particles of between 1-25 microns, and the hexagonal boron nitride may include particle of between 15-100 microns.

In another further embodiment of any of the foregoing air seal embodiments, a ratio between the amount by volume of hexagonal boron nitride to metallic alloy may be about 40-60% in the matrix, and a total percent by volume of hexagonal boron nitride may be greater than 70%.

In another further embodiment of any of the foregoing air seal embodiments, the thermal barrier coating layer may have a thickness of about 15 mils (0.38 mm), and the abradable layer may have a thickness of about 40 mils (1.01 mm).

Another embodiment addresses a gas turbine engine that may include first structure; a second structure rotating relative to the first structure, wherein one of the first and second structures provides a substrate; a thermal barrier coating layer adhered to the substrate; and an abradable layer adhered to the thermal barrier coating layer. The abradable layer may include: a matrix of agglomerated hexagonal boron nitride and a metallic alloy, and an hexagonal boron nitride, wherein the hexagonal boron nitride is interspersed with the matrix.

In a further embodiment of the foregoing gas turbine engine embodiment, the substrate may be an outer case, and the other rotating structure may be a blade tip. The blade tip may be arranged adjacent the outer case without any intervening, separable seal structure.

In another further embodiment of either of the foregoing gas turbine engine embodiments, the thermal barrier coating layer may have a thickness of about 15 mils (0.38 mm), and the abradable layer may have a thickness of about 40 mils (1.01 mm).

In another further embodiment of any of the foregoing gas turbine engine embodiments, the abradable layer may have a strength of at least 1000 psi (6.89 MPa).

Another embodiment addresses a method of manufacturing a gas turbine engine air seal. This method may include depositing a thermal barrier coating onto a substrate; and depositing an abradable coating onto the thermal barrier coating. The step of depositing an abradable coating may include agglomerating a matrix of hexagonal boron nitride powder and a fine metallic alloy powder; and mixing with the matrix a hexagonal boron nitride powder.

In a further embodiment of the foregoing method, the thermal barrier coating may provide a layer having a thickness of about 15 mils (0.38 mm), and the abradable coating may provide a layer having a thickness of about 40 mils (1.01 mm).

In a further embodiment of either of the foregoing method embodiments, the abradable coating layer may have a strength of at least 1000 psi (6.89 MPa).

These and other features of the present invention can be best understood from the following specification and drawings, the following of which is a brief description.

DETAILED DESCRIPTION OF THE PREFERRED EMBODIMENT

Figure 1:
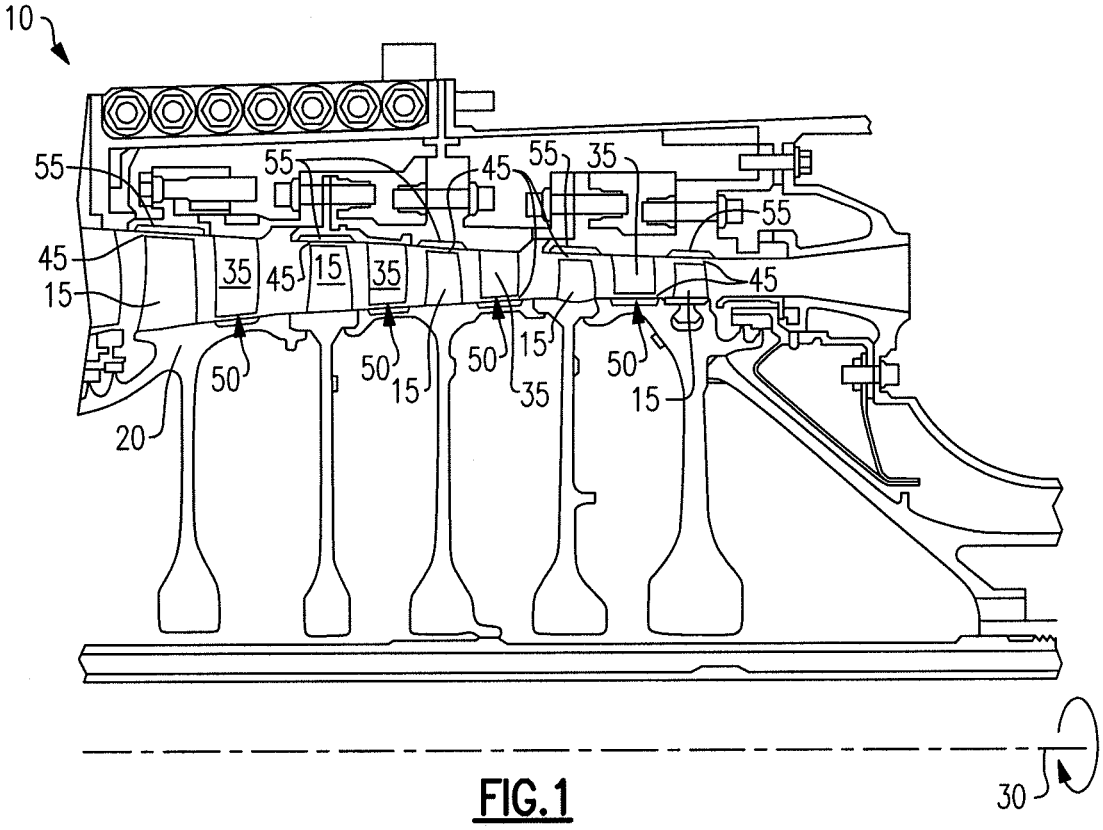
FIG. 1 shows a perspective view of a portion of a gas turbine engine incorporating an air seal.

FIG. 1 shows a portion of a gas turbine engine 10, for example, a high pressure compressor section. The engine 10 has blades 15 that are attached to a hub 20 that rotate about an axis 30. Stationary vanes 35 extend from an outer case 55 (or housing 40), which may be constructed from a nickel alloy, and are circumferentially interspersed between the blades 15, which may be constructed from titanium in one example. A first gap 45 exists between the blades 15 and the outer case 40, and a second gap 50 exists between the vanes 35 and the hub 20.

Figure 2:
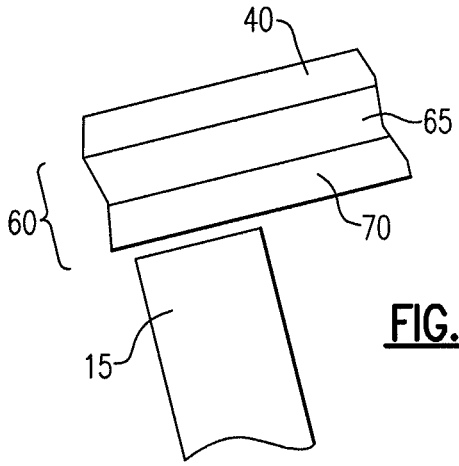
FIG. 2 shows a schematic view of an air seal.

Air seals 60 (FIG. 2) are positioned in at least one of the first and second gaps 45, 50. Further, the air seals 60 may be positioned on: (a) the outer edge of the blades 15; (b) the inner edge of the vanes 35; (c) an outer surface of the hub 30 opposite the vanes 35; and/or (d) as shown in FIG. 2, on the inner surface of outer case 40 opposite the blades 15. It is desirable that the gaps 45, 50 be minimized and interaction between the blades 15, vanes 35 and seals 60 occur to minimize air flow around blade tips or vane tips.

In one example shown in FIG. 2, the air seal 60 is integral with and supported by a substrate, in the example, the outer case 40. That is, the air seal 60 is deposited directly onto the outer case 40 without any intervening, separately supported seal structure, such as a typical blade outer air seal. The tip of the blade 15 is arranged in close proximity to the air seal 60. It should be recognized that the seal provided herein may be used in any of a compressor, a fan or a turbine section and that the seal may be provided on rotating or non-rotating structure.

The air seal 60 includes a thermal barrier coating (TBC) 65 deposited onto the outer case 40 to a desired thickness of, for example, 15-25 mils (0.38-0.64 mm), and in one example, 15 mils (0.38 mm). In the example, the TBC 65 is a ceramic material, such as gadolinium-zirconium oxide, yttrium-zirconium oxide. One suitable example of a TBC is available under Pratt & Whitney specification PWA265, which is a 7% yttria stabilized zirconia air plasma sprayed over a MCrAlY bond coat, where M includes at least one of nickel, cobalt, iron, or a combination thereof.

A directly integrated TBC enables reduced part count, reduced weight and reduced leakage losses. Typically, the abradable coating is applied to an outer air seal shroud which is mounted radially inboard from an outer casing that provides titanium fire containment. The casing is either thick enough to prevent burn through or it has a TBC coating on its inner surface. With a combined abradable and TBC coating system, the outer air seal and compressor casing can be combined while still providing desired protection against potential wall melt-through in the event of a titanium fire.

The air seal 60 also includes an outer abradable layer 70 deposited onto the TBC 65. The abradable coating consists of a material that is a bimodal mix of a fine composite matrix of metallic-based alloy (such as a Ni based alloy, though others such as cobalt, copper and aluminum are also contemplated herein) and hexagonal boron nitride ("hBN"), and inclusions of larger hBN. Feed stock used to provide the air seal 60 is made of composite powder particles of Ni alloy and hBN held together with a binder, plus hBN particles that are used at a variable ratio to the agglomerated composite powder to adjust and target the coating properties during manufacture. One of ordinary skill in the art will recognize that other compounds such as a relatively soft ceramic like bentonite clay may be substituted for the hBN.

The matrix of Ni based alloy and hexagonal boron nitride (hBN) includes hBN particles in the range 1-10 micron particle sizes and the Ni based alloy in the range of 1-25 microns particle size. Polyvinyl alcohol may be used as a binder to agglomerate the particles of Ni based alloy and hBN before thermal spraying. Alternatively, the Ni based alloy may be coated upon the hBN before thermal spraying.

Larger particles of hBN are added to the fine composite matrix prior to spraying or during spraying. The larger hBN particles are in the range of 15-100 microns particle size, though 20-75 microns particle size may be typical. The volume fraction of hBN in the composite coating is about 50-80%. The metal content may be around 50% by volume or less. In one example, a volume fraction of hBN in the range of 75-80% is used.

The metal and hBN composite coating bonds with the TBC 65 through mechanical interlocking with the rough surface of the air plasma sprayed (APS) TBC, which provides a durable, low stress abradable layer that will remain bonded to the TBC 65 during engine service including rub events. As a result, the typical, separate seal structure, such as a blade outer air seal, may be unnecessary.

The powders are deposited by a known thermal spray process, such as high velocity oxygen fuel spraying (HVOF) or air plasma spray (APS). Fine particle-sized hBN powders and the fine particle-sized Ni alloy powders being pre-agglomerated as described, are deposited on the TBC by thermal spray. The larger particle-sized hBN particles may be added to the agglomerates as a particle blend and delivered to the spray apparatus pre-blended, or may be delivered to the spray apparatus through a separate delivery system. However, it is also possible to include the larger hBN particles in the agglomerates of matrix material.

Typically, the matrix of agglomerated hBN powder and metallic alloy powder and the larger hBN powder are fed into the plasma plume from separate powder feeders. The abradable layer 70 is deposited onto the TBC 65 to a desired thickness, for example, 15-150 mils (0.38-3.80 mm) and, in one example, 80 mils (2.03 mm) and in another example, 40 mils (1.01 mm).

In the foregoing embodiments, by creating a lower modulus coating that has very low residual stresses from deposition, the co-spraying of metal hBN composite particles with agglomerated hBN particles addresses bonding and delamination problems in the prior an art. Applied over a TBC such as PWA265, the abradable layer 70 forms an interconnected metal matrix that is itself filled with hBN. This filled metal matrix itself has a reduced elastic modulus and residual stress, and density. In combination with well-defined agglomerated hBN particle deposition, the filled metal phase forms a well interconnected matrix which provides good strength, toughness and erosion resistance at a given metal content.

Although an example embodiment has been disclosed, a worker of ordinary skill in this art would recognize that certain modifications would come within the scope of the claims. For that reason, the following claims should be studied to determine their true scope and content.

What is claimed is:

1. An air seal for use with rotating structure in a gas turbine engine comprising:
- a substrate;
- a thermal barrier coating layer adhered to the substrate; and
- an abradable layer adhered to the thermal barrier coating layer, the abradable layer comprising:
  - a matrix of agglomerated hexagonal boron nitride and a metallic alloy, and
  - an hexagonal boron nitride, wherein the hexagonal boron nitride is interspersed with the matrix.

2. The air seal according to claim 1, wherein the substrate is metallic.

3. The air seal according to claim 1, wherein the thermal barrier coating is 7% yttria stabilized zirconia.

4. The air seal according to claim 1, wherein the abradable layer has a strength of at least 1000 psi (6.89 MPa).

5. The air seal according to claim 4, wherein the agglomerated hexagonal boron nitride comprises particles of between 1-10 microns, the fine metallic alloy comprise particles of between 1-25 microns, and the hexagonal boron nitride comprises particle of between 15-100 microns.

6. The air seal according to claim 5, wherein a ratio between the amount by volume of hexagonal boron nitride to metallic alloy is about 40-60% in the matrix, and a total percent by volume of hexagonal boron nitride is greater than 70%.

7. The air seal according to claim 4, wherein the thermal barrier coating layer has a thickness of about 15 mils (0.38 mm), and the abradable layer has a thickness of about 40 mils (1.01 mm).

8. A gas turbine engine comprising:
- a first structure;
- a second structure rotating relative to the first structure, wherein one of the first and second structures provides a substrate;
- a thermal barrier coating layer adhered to the substrate; and
- an abradable layer adhered to the thermal barrier coating layer, the abradable layer comprising:
  - a matrix of agglomerated hexagonal boron nitride and a metallic alloy, and
  - an hexagonal boron nitride, wherein the hexagonal boron nitride is interspersed with the matrix.

9. The gas turbine engine according to claim 8, wherein substrate is an outer case, and the other rotating structure is a blade tip, wherein the blade tip is arranged adjacent the outer case without any intervening, separable seal structure.

10. The gas turbine engine according to claim 8, wherein the thermal barrier coating layer has a thickness of about 15 mils (0.38 mm), and the abradable layer has a thickness of about 40 mils (1.01 mm).

11. The gas turbine engine according to claim 10, wherein the abradable layer has a strength of at least 1000 psi (6.89 MPa).

12. A method of manufacturing a gas turbine engine air seal comprising:

depositing a thermal barrier coating onto a substrate; and depositing an abradable coating onto the thermal barrier coating, including agglomerating a matrix of hexagonal boron nitride powder and a fine metallic alloy powder, and mixing with the matrix a hexagonal boron nitride powder.

13. The method according to claim 12, wherein the thermal barrier coating provides a layer having a thickness of about 15 mils (0.38 mm), and the abradable coating provides a layer having a thickness of about 40 mils (1.01 mm).

14. The method according to claim 13, wherein the abradable coating layer has a strength of at least 1000 psi (6.89 MPa).

* * * * *